US009534790B2

(12) United States Patent
Cai et al.

(10) Patent No.: US 9,534,790 B2
(45) Date of Patent: Jan. 3, 2017

(54) FUEL INJECTOR FOR SUPPLYING FUEL TO A COMBUSTOR

(71) Applicant: General Electric Company, Schenectady, NY (US)

(72) Inventors: Jun Cai, Greer, SC (US); Gregory Allen Boardman, Greer, SC (US); Hasan Karim, Simpsonville, SC (US); Lucas John Stoia, Taylors, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 892 days.

(21) Appl. No.: 13/735,340

(22) Filed: Jan. 7, 2013

(65) Prior Publication Data

US 2014/0190170 A1 Jul. 10, 2014

(51) Int. Cl.

| | |
|---|---|
| ***F23R 3/14*** | (2006.01) |
| ***F23R 3/34*** | (2006.01) |
| ***F23R 3/28*** | (2006.01) |

(52) U.S. Cl.

CPC ..... *F23R 3/346* (2013.01); *F23R 3/14* (2013.01); *F23R 3/286* (2013.01); *F23C 2900/07001* (2013.01)

(58) Field of Classification Search

CPC ..... F23R 3/12; F23R 3/14; F23R 3/286; F23C 7/004

USPC ..... 60/737, 740

See application file for complete search history.

(56) References Cited

U.S. PATENT DOCUMENTS

| | | | | |
|---|---|---|---|---|
| 6,192,688 | B1 | 2/2001 | Beebe | |
| 7,137,258 | B2 | 11/2006 | Widener | |
| 2010/0058767 | A1 | 3/2010 | Simons et al. | |
| 2010/0170216 | A1 | 7/2010 | Venkataraman et al. | |
| 2010/0170252 | A1 | 7/2010 | Venkataraman et al. | |
| 2011/0113784 | A1* | 5/2011 | Headland | F02C 7/22 60/737 |
| 2011/0277481 | A1 | 11/2011 | Bhagat | |
| 2012/0102958 | A1 | 5/2012 | Stoia et al. | |
| 2012/0266604 | A1* | 10/2012 | Popovic | F23C 7/004 60/772 |

* cited by examiner

*Primary Examiner* — Patrick Hamo

(74) *Attorney, Agent, or Firm* — Dority & Manning, PA

(57) ABSTRACT

A fuel injector for a combustor generally includes an annular outer body having an inlet and an outlet. The outer body at least partially defines an outer flow passage. An inner flow passage extends at least partially through the outer flow passage and a radial swirler is disposed at the inlet of the outer body. The radial swirler includes a first radial passage separated from a second radial passage. The first radial passage has a first plurality of swirler vanes and the second radial passage has a second plurality of swirler vanes. The first radial passage is in fluid communication with the outer flow passage and the second radial passage is in fluid communication with the inner flow passage.

17 Claims, 7 Drawing Sheets

FUEL INJECTOR FOR SUPPLYING FUEL TO A COMBUSTOR

FIELD OF THE INVENTION

The present invention generally involves a fuel injector for supplying fuel to a combustor. In particular, the fuel injector includes two radial flow passages, each passage having a plurality of turning vanes for imparting radial swirl to a compressed working fluid to premix the compressed working fluid and a fuel for combustion.

BACKGROUND OF THE INVENTION

Combustors are commonly used in industrial and power generation operations to ignite fuel to produce combustion gases having a high temperature and pressure. For example, turbo-machines such as gas turbines typically include one or more combustors to generate power or thrust. A typical gas turbine includes an inlet section, a compressor section, a combustion section, a turbine section, and an exhaust section. The inlet section cleans and conditions a working fluid (e.g., air) and supplies the working fluid to the compressor section. The compressor section increases the pressure of the working fluid and supplies a compressed working fluid to the combustion section. The combustion section mixes fuel with the compressed working fluid and ignites the mixture to generate combustion gases having a high temperature and pressure. The combustion gases flow to the turbine section where they expand to produce work. For example, expansion of the combustion gases in the turbine section may rotate a shaft connected to a generator to produce electricity.

The combustion section may include one or more combustors annularly arranged between the compressor section and the turbine section, and the temperature of the combustion gases directly influences the thermodynamic efficiency, design margins, and resulting emissions of the combustor. For example, higher combustion gas temperatures generally improve the thermodynamic efficiency of the combustor. However, higher combustion gas temperatures also promote flame holding conditions in which the combustion flame migrates towards the fuel being supplied by nozzles, possibly causing accelerated damage to the nozzles in a relatively short amount of time. In addition, higher combustion gas temperatures generally increase the disassociation rate of diatomic nitrogen, increasing the production of nitrogen oxides ($NO_X$) for the same residence time in the combustor. Conversely, a lower combustion gas temperature associated with reduced fuel flow and/or part load operation (turndown) generally reduces the chemical reaction rates of the combustion gases, increasing the production of carbon monoxide and unburned hydrocarbons for the same residence time in the combustor.

In a particular combustor design, the combustor may include a cap assembly that extends radially across at least a portion of the combustor, and one or more fuel nozzles may be radially arranged across the cap assembly to supply fuel to the combustor. The combustor may also include at least one annular liner that extends downstream from the cap assembly. The liner at least partially defines a combustion chamber within the combustor. The liner further defines a hot gas path that extends between the combustion chamber and an inlet to the turbine. The fuel nozzles may include swirler vanes and/or other flow guides to enhance mixing between the fuel and the compressed working fluid to produce a lean fuel-air mixture for combustion. The swirling fuel-air mixture flows into the combustion chamber where it ignites to generate the hot combustion gases. The hot combustion gases are routed through the hot gas path to the inlet of the turbine.

The combustor may further include one or more fuel injectors circumferentially arranged around the combustion chamber and/or the liner to supply additional fuel for combustion to the combustion chamber and/or to the hot gas path generally downstream from the combustion chamber. This system and method for operating a combustor is commonly referred to in the power generation industry as Late Lean Injection or LLI. The additional fuel supplied by the fuel injectors increases the firing temperature of the combustor without producing a corresponding increase in the residence time of the combustion gases inside the combustion chamber.

Although generally effective at enabling higher operating temperatures, the overall effectiveness of the LLI is at least partially dependent upon how well the fuel-air combination that flows from the injector mixes with the swirling fuel-air mixture in the combustion chamber and/or with the hot combustion gases flowing through the liner generally downstream from the combustion chamber. For example, enhanced mixing of the fuel-air combination from the injector with the swirling fuel-air mixture in the combustion chamber and/or with the hot combustion gases flowing through the liner reduces peak flame temperature within the combustor, thereby reducing NOx levels. As a result, a system for supplying fuel to a combustor that enhances mixing of the fuel-air combination that flows from the fuel injectors circumferentially arranged around the combustion chamber and/or the liner with the swirling fuel-air mixture in the combustion chamber and/or with the hot combustion gases flowing through the liner would be useful.

BRIEF DESCRIPTION OF THE INVENTION

Aspects and advantages of the invention are set forth below in the following description, or may be obvious from the description, or may be learned through practice of the invention.

One embodiment of the present invention is a fuel injector for a combustor. The fuel injector includes an annular outer body having an inlet and an outlet. The outer body at least partially defines an outer flow passage. An inner flow passage extends at least partially through the outer flow passage and a radial swirler is disposed at the inlet of the outer body. The radial swirler includes a first radial passage separated from a second radial passage. The first radial passage has a first plurality of swirler vanes and the second radial passage has a second plurality of swirler vanes. The first radial passage is in fluid communication with the outer flow passage and the second radial passage is in fluid communication with the inner flow passage.

Another embodiment of the present invention is a fuel injector for a combustor. The fuel injector includes an annular outer body having an inlet at an upstream end. The outer body at least partially defines an outer flow passage. An inner flow passage extends at least partially through the outer flow passage. A radial swirler is disposed at the inlet of the outer body of the fuel injector. The radial swirler includes a radially extending cap plate that is disposed at a top portion of the radial swirler. A radially extending annular plate is disposed between the inlet of the outer body and the cap plate. The annular plate at least partially defines an inner flow passage that extends within the outer flow passage. A first radial passage includes a first plurality of radially extending swirler vanes that extend axially between the upstream end of the outer body and the annular plate. The first radial passage being in fluid communication with the outer flow passage of the outer body. A second radial passage includes a second plurality of radially extending swirler vanes that extend axially between the annular plate and the cap plate. The second radial passage being in fluid communication with the inner flow passage.

The present invention may also include a gas turbine having a compressor, a combustor downstream from the compressor and a turbine downstream from the combustor. The combustor generally includes a combustion chamber, a liner that circumferentially surrounds at least a portion of the combustion chamber, a plurality of fuel nozzles that are radially arranged across the combustor upstream from the combustion chamber, and a fuel injector that extends at least partially through the liner downstream from the plurality of fuel nozzles. The fuel injector having an annular outer body having an inlet and an outer flow passage. An inner flow passage extends at least partially through the outer flow passage. A radial swirler is disposed at the inlet of the outer body. The radial swirler includes a first radial passage having a first plurality of swirler vanes and a second radial passage including a second plurality of swirler vanes. The first radial passage is in fluid communication with the outer flow passage and the second radial passage is in fluid communication with the inner flow passage.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
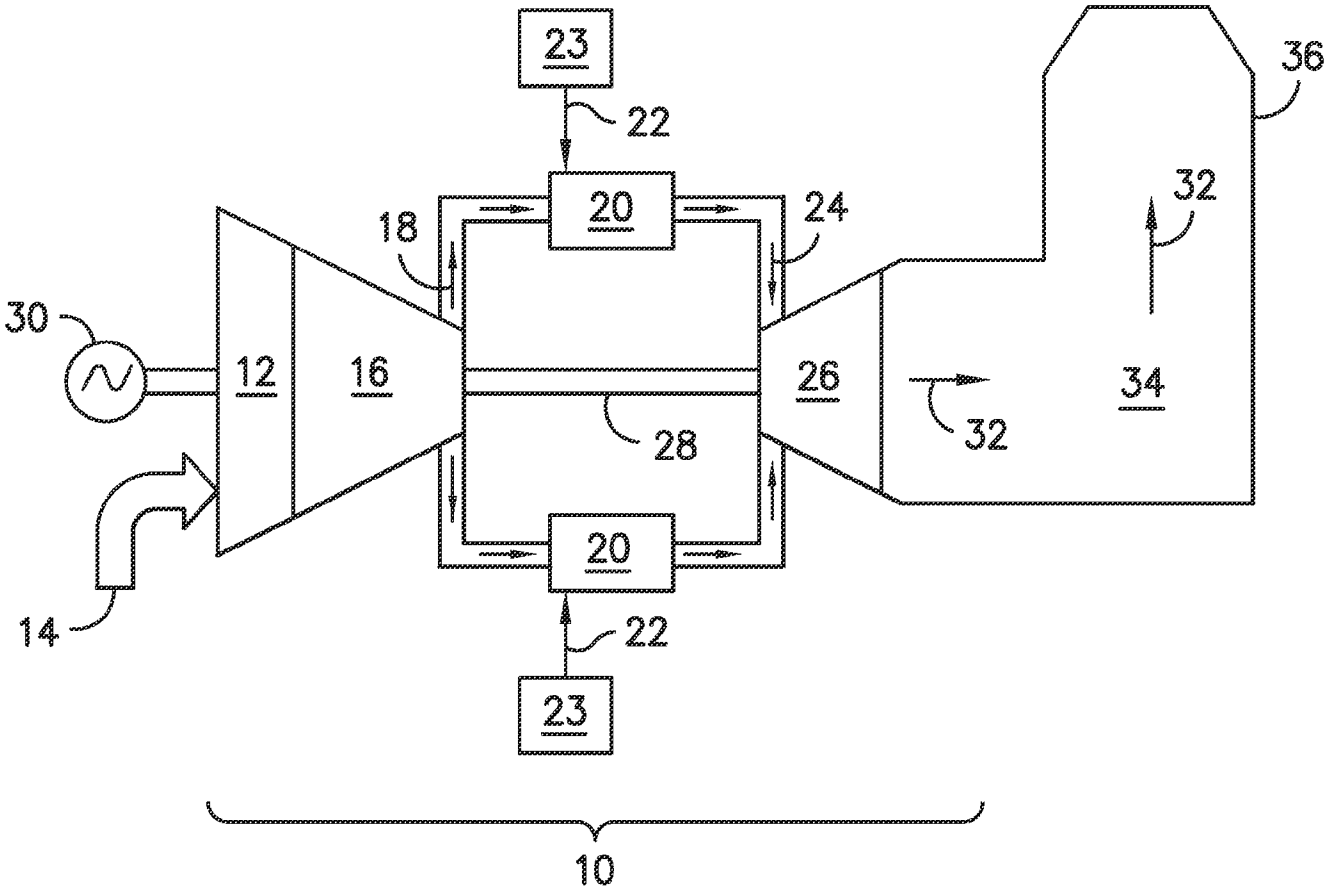
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a fuel injector for a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state. The compressed working fluid 18 flows to a combustion section where one or more combustors 20 ignite fuel 22 from a fuel supply 23 with the compressed working fluid 18 to produce combustion gases 24 having a high temperature and pressure. The combustion gases 24 flow through a turbine section having a turbine 26 to produce work. For example, the turbine 26 may be connected to a shaft 28 so that rotation of the turbine 26 drives the compressor 16 to produce the compressed working fluid 18. Alternately or in addition, the shaft 28 may connect the turbine 26 to a generator 30 for producing electricity. Exhaust gases 32 from the turbine 26 flow through an exhaust section 34 that may connect the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
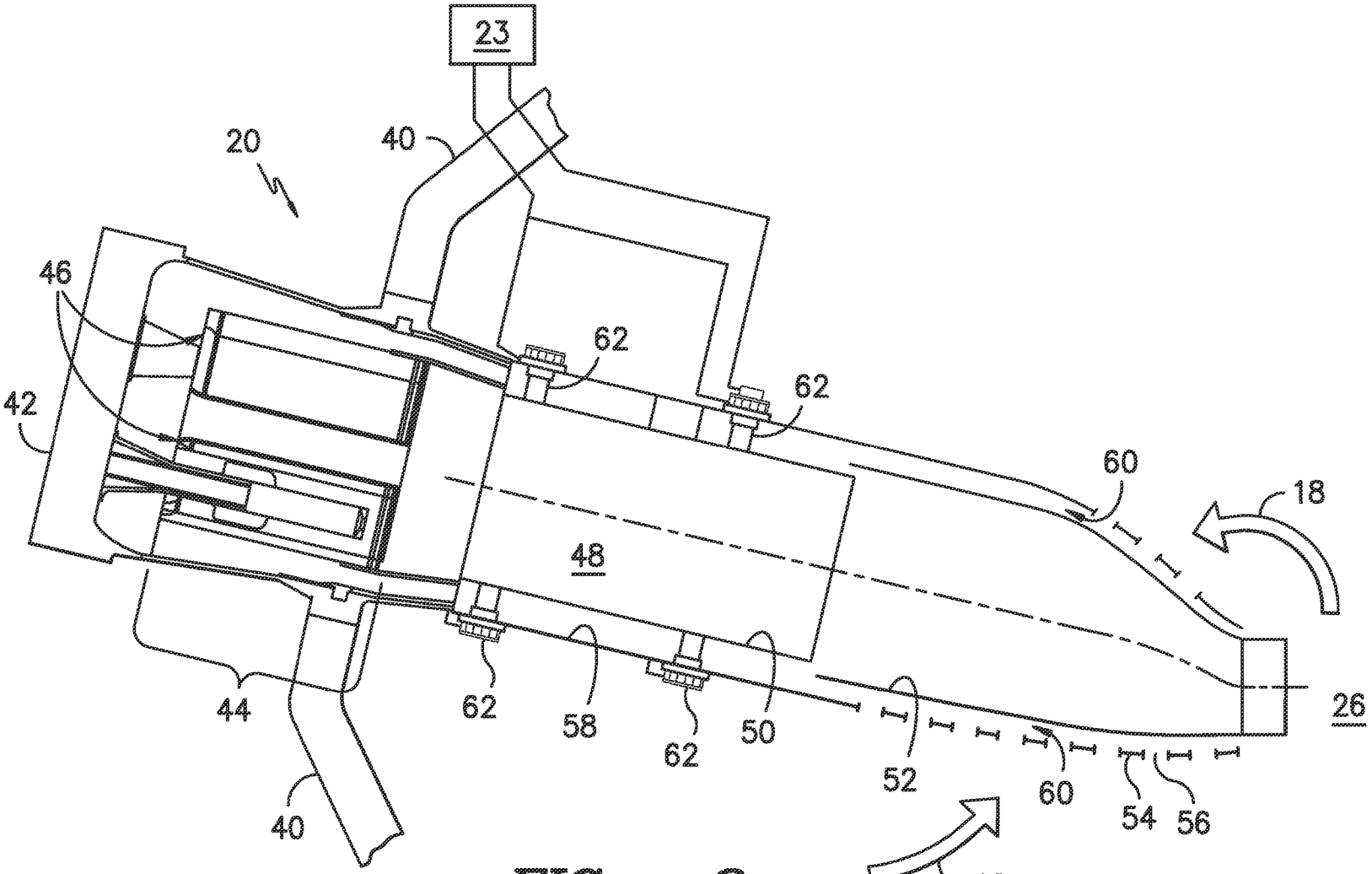
FIG. 2 is a simplified side cross-section view of an exemplary combustor according to various embodiments of the present invention.

The combustors 20 may be any type of combustor known in the art, and the present invention is not limited to any particular combustor design unless specifically recited in the claims. FIG. 2 provides a simplified side cross-section view of an exemplary combustor 20 according to various embodiments of the present invention. As shown in FIG. 2, a casing 40 and an end cover 42 may combine to contain the compressed working fluid 18 flowing to the combustor 20. A cap assembly 44 may extend radially across at least a portion of the combustor 20, and one or more axially extending fuel nozzles 46 may be radially arranged across the cap assembly 44 to supply the fuel 22 to a combustion chamber 48 downstream from the cap assembly 44. A liner 50 may circumferentially surround at least a portion of the combustion chamber 48, and a transition duct 52 downstream from the liner 50 may connect the combustion chamber 48 to the inlet of the turbine 26. An impingement sleeve 54 with flow holes 56 may circumferentially surround the transition duct 52, and a flow sleeve 58 may circumferentially surround the liner 50. In this manner, the compressed working fluid 18 may pass through the flow holes 56 in the impingement sleeve 54 to flow through an annular passage 60 outside of the transition duct 52 and liner 50 to provide convective cooling to the transition duct 52 and liner 50. When the compressed working fluid 18 reaches the end cover 42, the compressed working fluid 18 reverses its direction to flow through the fuel nozzles 46 and cap assembly 44 into the combustion chamber 48.

Figure 3:
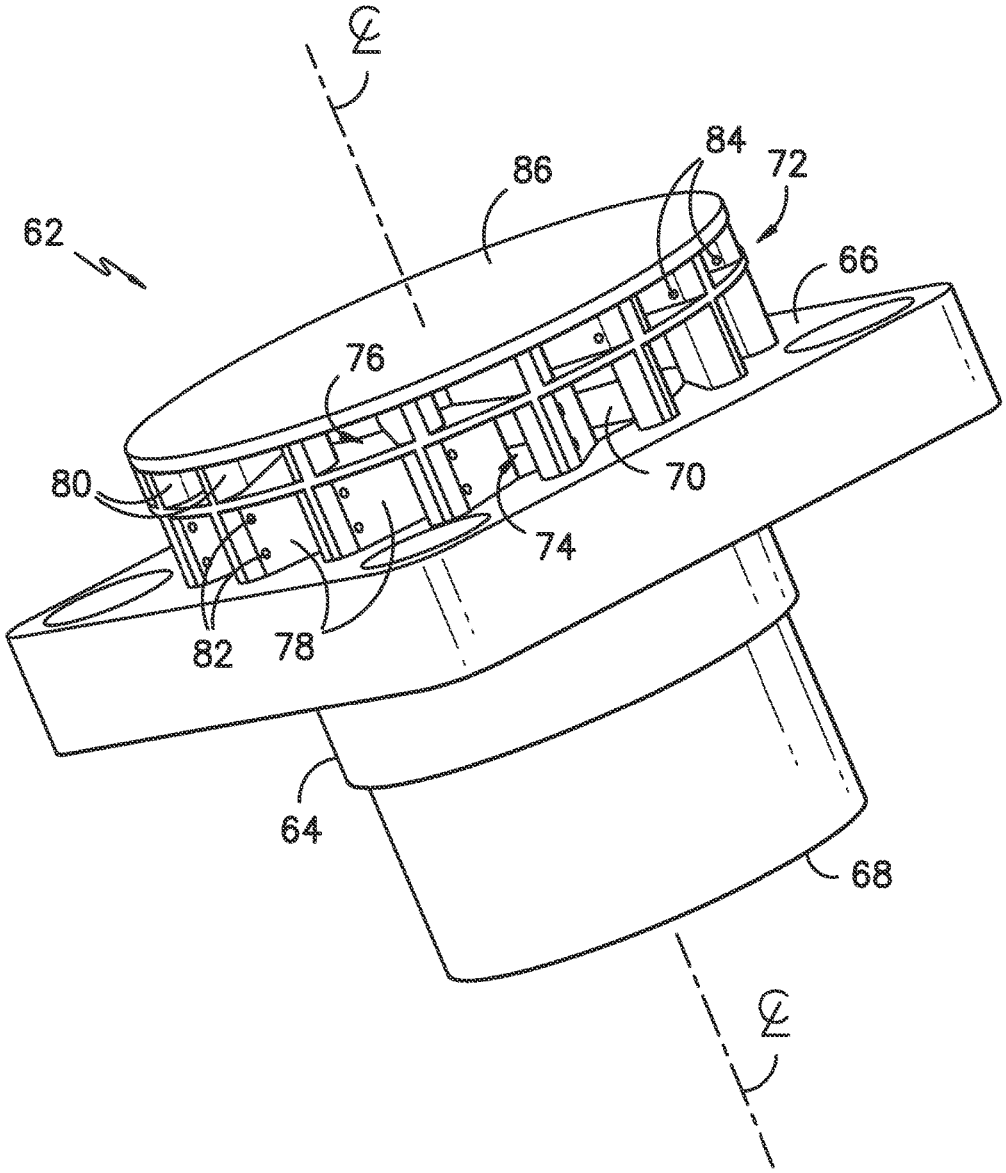
FIG. 3 provides a perspective view of a fuel injector according to at least one embodiment of the present invention.
Figure 4:
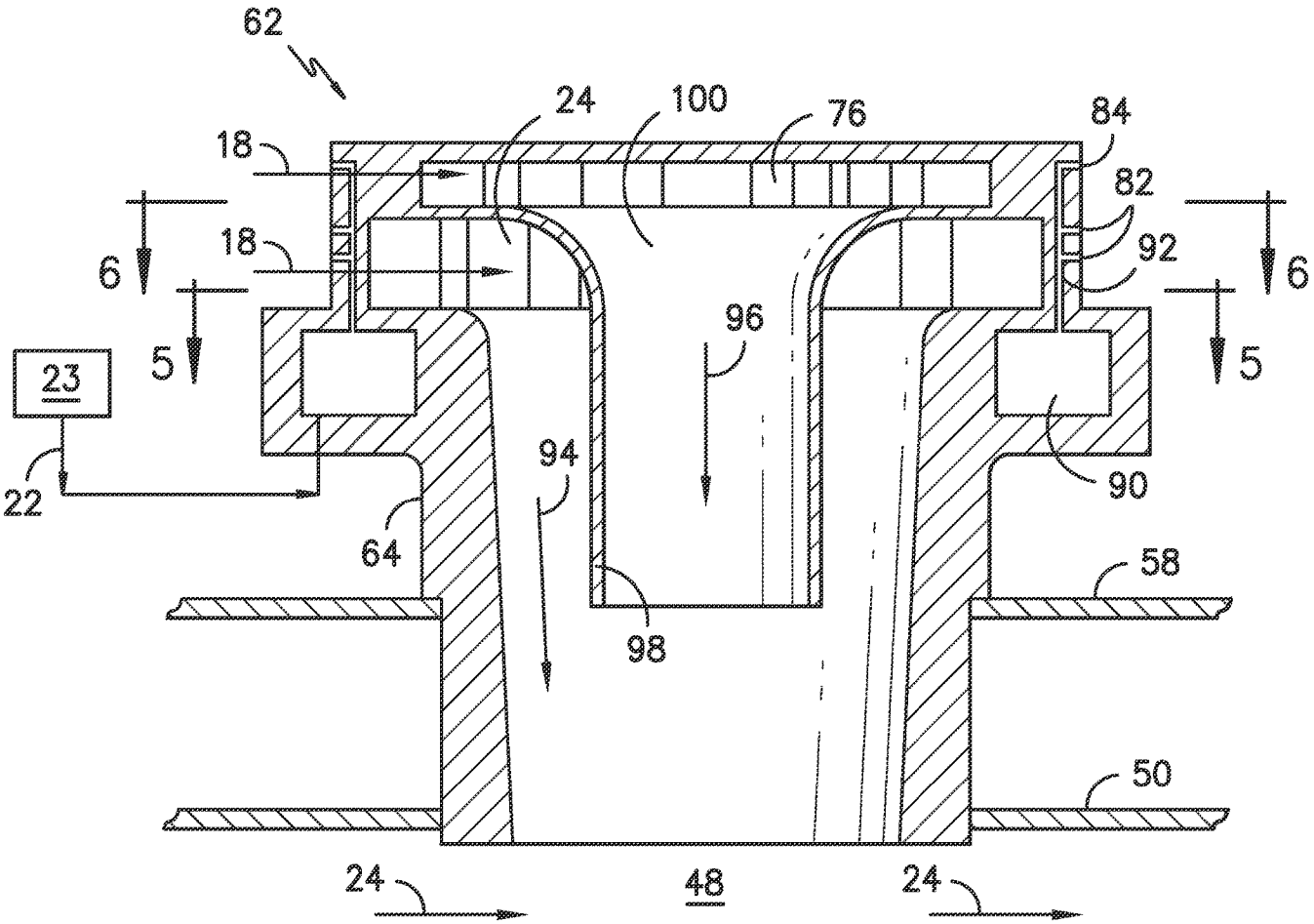
FIG. 4 provides an enlarged cross-section side view of the fuel injector as shown in FIG. 3.

The combustor 20 may further include one or more fuel injectors 62 downstream from the fuel nozzles 46 that that may provide a late lean injection of fuel 22 and compressed working fluid 18 for combustion. FIG. 3 provides a perspective view of the fuel injector 62 as shown in FIG. 2 according to at least one embodiment of the present invention, and FIG. 4 provides an enlarged side cross-section view of the fuel injector 62 as shown in FIG. 3. As shown in FIG. 3, the fuel injector 62 generally includes an outer body 64 having an upstream end 66 axially separated from a downstream end 68 with respect to an axial centerline of the fuel injector 62.

An inlet 70 extends through the upstream end 66 of the outer body 64. A radial swirler 72 is disposed at the upstream end 66 of the outer body 64. The radial swirler 72 includes a first radial passage 74 that extends at least partially circumferentially around the inlet 70 of the outer body 64, and a second radial passage 76 that extends axially outward from the first radial passage 74 with respect to the axial centerline of the fuel injector 62. The first radial passage 74 includes a first plurality of radially extending swirler vanes 78 that project axially through the first radial passage 74 with respect to the axial centerline of the fuel injector 62. The radially extending swirler vanes of the first plurality of radially extending swirler vanes 78 are arranged in an annular array that at least partially surrounds the inlet 70 of the outer body 64. The second radial passage 76 includes a second plurality of radially extending swirler vanes 80 that project axially through the second radial passage 76 with respect to the axial centerline of the fuel injector 62. As shown in FIG. 3, at least some of the first plurality of radially extending swirler vanes 78 includes one or more fuel injection ports 82. In addition or in the alternative, at least some of the second plurality of radially extending swirler vanes 80 includes one or more fuel injection ports 84.

In particular embodiments, a cap plate 86 is disposed axially outward from the upstream end 66 of the outer body 64. The cap plate 86 extends radially across the second radial passage 76 of the radial swirler 72. A radially extending annular plate 88 is disposed between the first radial passage 74 and the second radial passage 76. The annular plate 88 may at least partially separate the first radial passage 74 from the second radial passage 76.

In particular embodiments, as shown in FIG. 4, the outer body 64 at least partially defines a fuel circuit 90 that extends at least partially through the outer body 64 of the fuel injector 62. The fuel circuit 90 may be in fluid communication with the fuel supply 23 through a series of fluid conduits that extend within and/or through the casing 40 of the combustion section as shown in FIG. 2. The fuel circuit 90 may be configured to flow a gaseous fuel and/or a liquid fuel. In various embodiments, as shown in FIG. 4, a fuel passage 92 is defined between the fuel circuit 90 and the fuel injection ports 82, 84 of the first and/or the second plurality of radially extending swirler vanes 78, 80.

As further illustrated in FIG. 4, the outer body 64 at least partially defines an outer flow passage 94 that extends through the outer body 64. The first radial passage 74 being in fluid communication with the outer flow passage 94. An inner flow passage 96 extends from the second radial passage 76 through the first radial passage 74 and at least partially through the outer flow passage 94. The inner flow passage 96 being at least partially defined by an inner body 98 having an outlet 99 at a downstream end. The inner body 98 extends downstream from the second radial passage 76. In particular embodiments, the annular plate 88 at least partially defines an inlet 100 to the inner flow passage 96. The inlet 100 may be conical shaped to route the compressed working fluid 18 and/or fuel from the second radial passage 76 into the inner flow passage 96. In further embodiments, the annular plate 88 at least partially defines the inner flow passage 96. As shown, the outer body 64 of the fuel injector 62 extends at least partially through the liner 50 and/or the flow sleeve 58 to define a flow path into the combustion chamber 48 and/or into the liner 50 downstream from the combustion chamber.

Figure 5:
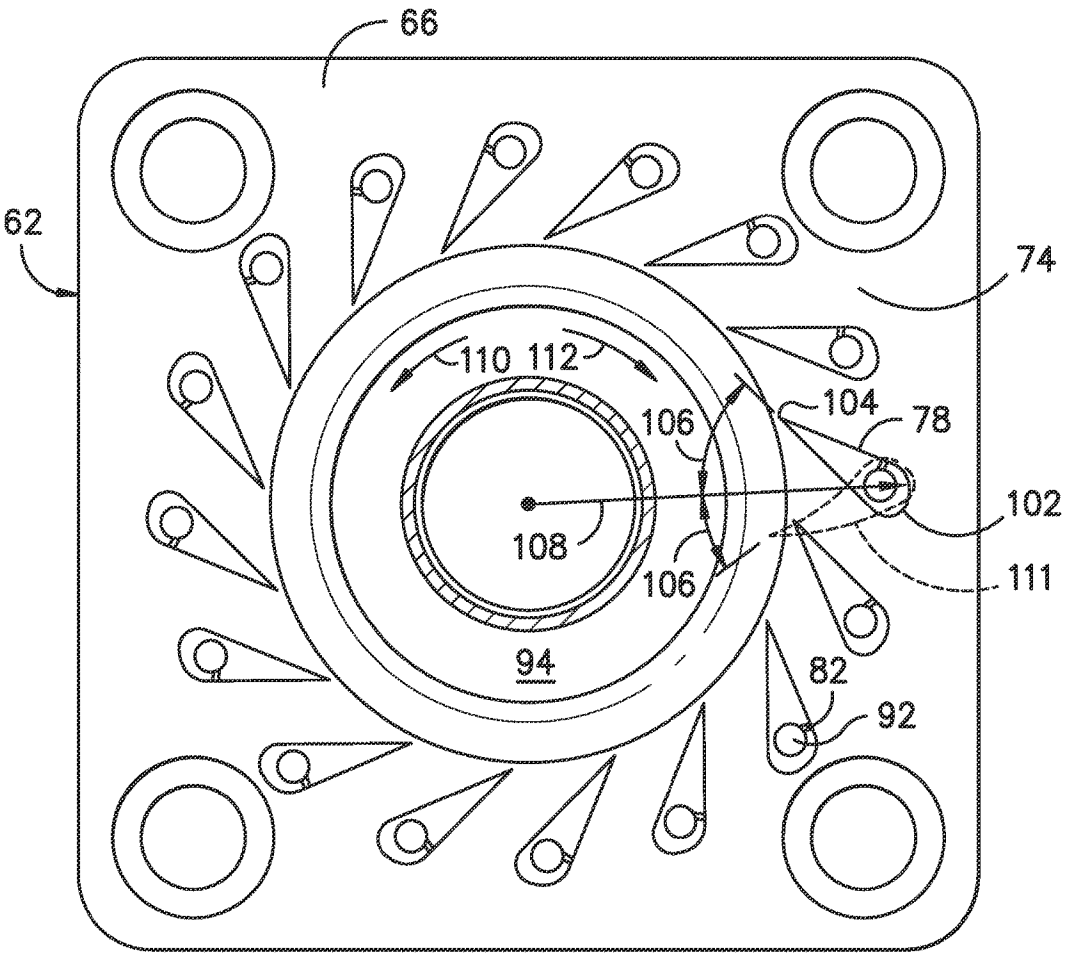
FIG. 5 provides a top view of a cross-section of the fuel injector taken along section line 5-5 as shown in FIG. 3.
Figure 6:
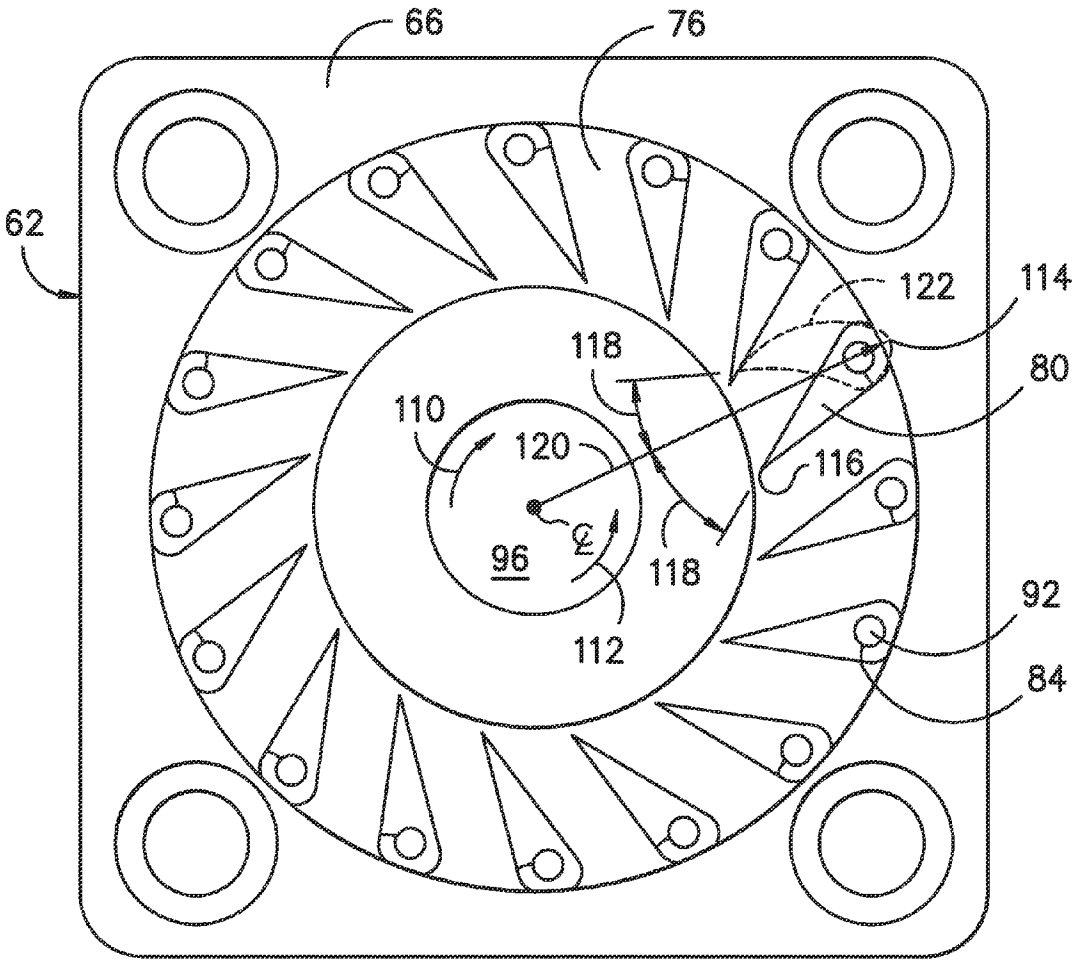
FIG. 6 provides a top view of a cross-section of the fuel injector taken along section line 6-6 as shown in FIG. 3.

FIG. 5 provides a cross-section top view of the first radial passage 74 of the fuel injector 62 as shown in FIG. 3 taken along section line 5-5, and FIG. 6 provides a cross-section top view of the second radial passage 76 of the fuel injector 62 as shown in FIG. 3 taken along section line 6-6. As shown in FIG. 5, each radially extending swirler vane 78 of the first plurality of radially extending swirler vanes 78 disposed within the first radial passage 74 includes a leading edge or radially outer point 102 and a trailing edge 104. The trailing edge 104 being arranged at a first swirl angle 106 with respect to a line 108 that extends radially between the axial centerline of the fuel injector 62 and the leading edge 102 of the swirler vane 78 through a plane that is perpendicular to the axial centerline of the fuel injector 62. A first swirl angle 106 that is greater than zero degrees as shown in FIG. 5 corresponds to a first rotational direction 110 such as a counter-clockwise direction with respect to the axial centerline of the fuel injector 62. A first swirl angle 106, as illustrated by dotted lines 111, that is less than zero degrees corresponds to a second rotational direction 112 such as a clockwise direction with respect to the axial centerline of the fuel injector 62.

As shown in FIG. 6, each radially extending swirler vane 80 of the second plurality of radially extending swirler vanes 80 disposed within the second radial passage 76 includes a leading edge or radially outer point 114 and a trailing edge 116. The trailing edge 116 being arranged at a second swirl angle 118 with respect to a line 120 that extends radially between the axial centerline of the fuel injector 62 and the leading edge 114 of the swirler vane 80 through a plane that is perpendicular to the axial centerline of the fuel injector 62. A second swirl angle 118 that is greater than zero degrees as illustrated by dotted lines 122 corresponds to the first rotational direction 110 such as a counter-clockwise direction with respect to the axial centerline of the fuel injector 62. A second swirl angle 118 that is less than zero degrees as shown in FIG. 6 corresponds to the second rotational direction 112 such as a clockwise direction with respect to the axial centerline of the fuel injector 62.

In particular embodiments, the first swirl angle 106 is between about forty degrees and about sixty degrees. In particular embodiments, the second swirl angle 118 is between about negative forty degrees and about forty degrees. In particular embodiments, the first swirl angle 106 and the second swirl angle 118 produce co-rotating swirl or rotation in the same direction within the first radial passage 74 and the second radial passage 76 respectively. For example, where the first swirl angle 106 and the second swirl angle 118 are both greater than or less than zero degrees. In other embodiments, the first swirl angle 106 and the second swirl angle 118 produce counter-rotating swirl or rotation in opposite rotational directions within the first radial passage 74 and the second radial passage 76 respectively.

In operation, as shown in FIGS. 3 through 6, a first portion of the compressed working fluid 18 from the compressor is routed into the first radial passage 74 of the fuel injector 62. Fuel 22 is injected through the fuel injection ports 82 of the first plurality of radially extending swirler vanes 78. The first plurality of radially extending swirler vanes 88 impart radial swirl at a first swirl angle 106 to the first portion of the compressed working fluid 18 and/or to the fuel 22. The first portion of the compressed working fluid 18 and the fuel 22 are mixed in the first radial flow passage 74 and/or the outer flow passage 94 as the combination flows towards the outlet 68 of the outer body 64. Simultaneously, a second portion of the compressed working fluid 18 is routed into the second radial passage 76 of the fuel injector 62. Fuel 22 is injected through the fuel injection ports 84 of the second plurality of radially extending swirler vanes 80. The second plurality of radially extending swirler vanes 80 impart radial swirl to the second portion of the compressed working fluid 18 and/or to the fuel 22 at a second swirl angle 118 which is generally less than the first swirl angle 106 of the first plurality of radially extending swirler vanes 78. The second portion of the compressed working fluid 18 and the fuel 22 are mixed in the inner flow passage 96 as the combination flows towards the outlet 99 of the inner body 98. By having different first and second swirl angles 106, 118 and/or different flow rates through the first and second radial passages 74, 76 premixing of the fuel 22 and the compressed working fluid 18 flowing from the fuel injector 62 into the combustion chamber 48 is enhanced, thereby improving mixture with a swirling flow of fuel and compressed working that flows into the combustion chamber from the axially extending fuel nozzles. As a result, peak flame temperature within the combustor is reduced, thus reducing the NOx production. In addition, the radial swirl within the inner flow passage may be less than the radial swirl within the outer flow passage, thereby preventing the generation of a recirculation zone inside the fuel injector.

Figure 7:
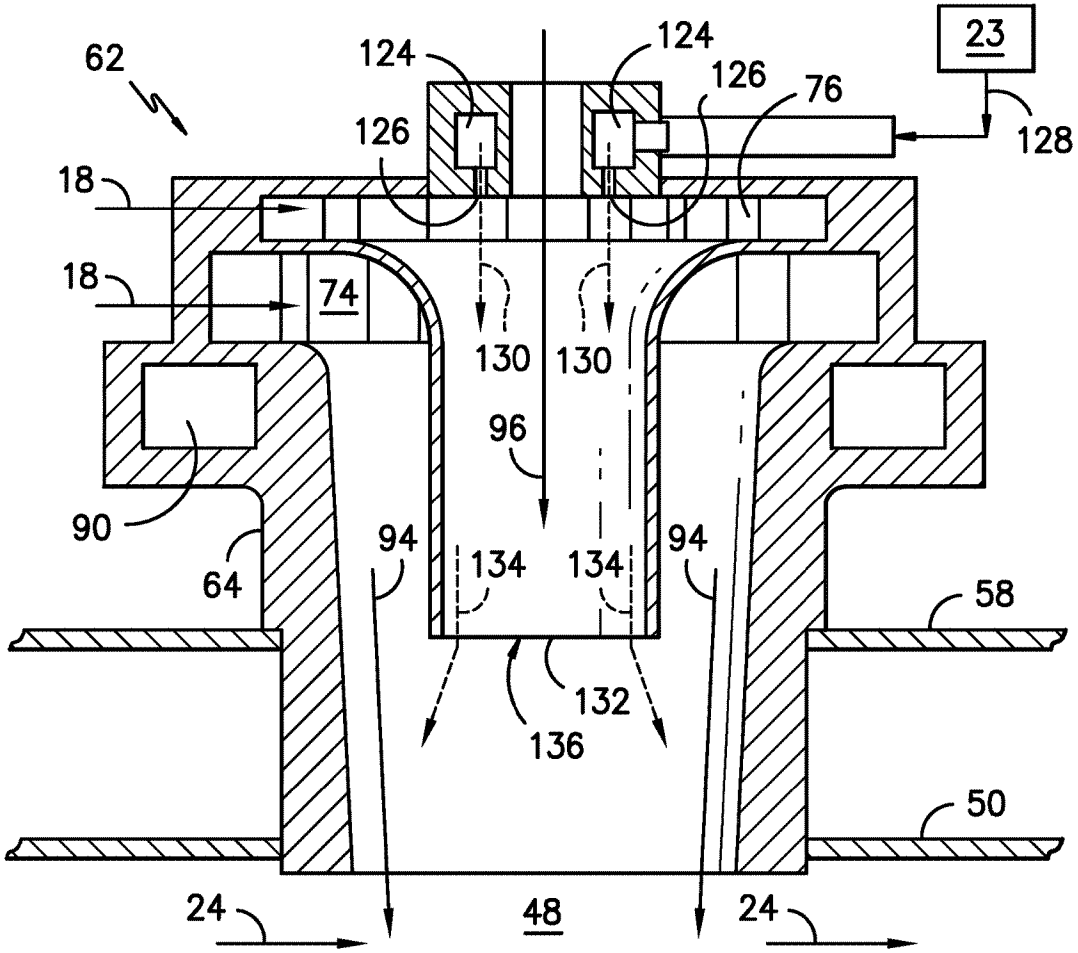
FIG. 7 provides a cross-section side view of the fuel injector as shown in FIG. 3, according to at least one embodiment of the present invention.

FIG. 7 provides a cross-section view of the fuel injector 62 as shown in FIG. 2, according to at least one alternate embodiment of the present invention. As shown in FIG. 7, the fuel injector 62 may further include a liquid fuel plenum 124. One or more fuel injection ports 126 provide for fluid communication between the liquid fuel plenum 124 and the second radial passage 76 and/or the inner flow passage 96. As shown, the liquid fuel plenum 124 may be coupled to the cap plate 86 of the fuel injector 62. The liquid fuel plenum 124 may at least partially define an axial flow path 126 that extends at least partially through the liquid fuel plenum 124 and into at least one of the second radial flow passage 76 or the inner flow passage 96.

In the embodiment as shown in FIG. 7, the compressed working fluid 18 flows into the second radial passage 76 where the second plurality of swirler vanes 80 imparts radial swirl to the compressed working fluid 18 in either the first or the second rotational directions 110, 112. A liquid fuel 128 is atomized as it is injected from the liquid fuel plenum 124 into the second radial passage 76 and/or into the inner flow passage 96. The radially swirling compressed working fluid 18 premixes with a first portion 130 of the liquid fuel 128 as the mixture flows through the inner flow passage 96 towards an outlet 132 of the inner body 98. A second portion 134 of the liquid fuel 128 comprising of larger droplets of the liquid fuel than the first portion 130 may centrifuge to the inner body 98. The second portion 134 of the liquid fuel 128 is pushed through the inner body 98 by the swirling motion of the mixture of the compressed working fluid 18 and the liquid fuel 128 as it flows axially outward from the inner flow passage 96. As the second portion 134 of the liquid fuel 128 flows across an edge 136 of the outlet 132 of the inner body 98, the swirling compressed working fluid 18 flowing through the outer flow passage 94 air blasts or further atomizes the second portion 134 of the liquid fuel 128, thereby improving mixing of the liquid fuel 128 and the compressed working fluid 18 within the fuel injector 62 before it is introduced into the combustion chamber 48 and/or through the liner 50 downstream of the combustion chamber 48.

The invention as disclosed herein and as illustrated in FIGS. 2 through 7 provide various technological advantages and/or improvements over existing fuel injectors and combustors. The invention maintains a high swirl angle and reasonable axial velocity within the outer flow passage to enhance mixing inside the swirler and to enhance the mixing of the fuel and air flowing from the fuel injector with fuel and air supplied to the combustion chamber from the axially extending fuel nozzles which reduces the peak flame temperature and thus reduces production of undesirable emissions such as oxides of nitrogen or NOx. In addition, the reduced swirl from inner swirler prevents generation of a recirculation zone inside the swirler which reduces thermal stress on the fuel injector. Another benefit of the invention is that the fuel-to-air ratio or volume of fuel divided by the volume of air profile at the fuel injector exit can be controlled so that the NOx performance can be optimized. As a result, various embodiments of the present invention may allow extended combustor operating conditions, extend the life and/or maintenance intervals for various combustor components, maintain adequate design margins of flame holding, and/or reduce undesirable emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel injector for a combustor, the fuel injector comprising:

a. an annular outer body having an inlet at an upstream end, the outer body at least partially defining an outer flow passage;

b. an inner flow passage that extends at least partially through the outer flow passage of the outer body; and c. a radial swirler disposed at the inlet of the outer body of the fuel injector, the radial swirler comprising:

a radially extending cap plate disposed at a top portion of the radial swirler;

a radially extending annular plate disposed between the inlet of the outer body and the cap plate, the annular plate at least partially defining an inner flow passage that extends within the outer flow passage;

a first radial passage having a first plurality of swirler vanes that extend axially between the upstream end of the outer body and the annular plate, wherein the first radial passage is in fluid communication with the outer flow passage of the outer body, wherein the first plurality of swirler vanes is oriented perpendicular to an axial centerline of the fuel injector;

a second radial passage having a second plurality of swirler vanes that extend axially between the annular plate and the cap plate, wherein the second radial passage is in fluid communication with the inner flow passage, wherein the second plurality of swirler vanes is oriented perpendicular to the axial centerline of the fuel injector; and a liquid fuel plenum that extends through the cap plate, the liquid fuel plenum being in fluid communication with at least one of the second radial passage or the inner flow passage.

2. The fuel injector as in claim 1, further comprising an axial flow path that extends at least partially through the liquid fuel plenum and into at least one of the second radial passage or the inner flow passage.

3. The fuel injector as in claim 1, further comprising a fuel circuit that extends at least partially through the outer body, wherein at least one of the swirler vanes of the first plurality of swirler vanes or at least one of the swirler vanes of the second plurality of swirler vanes includes a fuel injection port, the fuel injection port being in fluid communication with the fuel circuit.

4. The fuel injector as in claim 1, further comprising an annular inner body that further defines the inner flow passage, wherein the inner body extends downstream from the annular plate.

5. The fuel injector as in claim 1, wherein each swirler vane of the first plurality of swirler vanes includes a leading edge and a trailing edge, the trialing edge being arranged at a first swirl angle with respect to a first radial line that extends between the axial centerline of fuel infector and the leading edge.

6. The fuel injector as in claim 5, wherein each swirler vane of the second plurality of swirler vanes includes a leading edge and a trailing edge, the trialing edge being arranged at a second swirl angle with respect to a second radial line that extends between the axial centerline of fuel injector and the leading edge, wherein the first swirl angle with respect to the first radial line and the second swirl angle with respect to the second radial line are different.

7. A gas turbine comprising:

a. a compressor, a combustor downstream from the compressor and a turbine downstream from the combustor, the combustor comprising:

a combustion chamber;

a liner that circumferentially surrounds at least a portion of the combustion chamber;

a plurality of fuel nozzles coupled to an end cover of the combustor and extending axially downstream from the end cover and terminating upstream from the combustion chamber; and a fuel injector that extends radially through the liner downstream from the plurality of fuel nozzles, the fuel injector comprising:

(1) an annular outer body defining an inlet, an outlet and an outer flow passage, wherein the outer flow passage tapers radially inwardly along an axial centerline of the fuel injector from the inlet to the outlet;

(2) an inner flow passage that extends at least partially through the outer flow passage; and (3) a radial swirler disposed at the inlet of the outer body, the radial swirler having a first radial passage including a first plurality of swirler vanes and a second radial passage including a second plurality of swirler vanes, the first radial passage being in fluid communication with the outer flow passage and the second radial passage being in fluid communication with the inner flow passage, wherein at least one of the swirler vanes of the first plurality of swirler vanes includes a fuel injection port and at least one of the swirler vanes of the second plurality of swirler vanes includes a fuel injection port.

8. The gas turbine as in claim 7, wherein each swirler vane of the first plurality of swirler vanes includes a leading edge and a trailing edge, the trialing edge being arranged at a first swirl angle with respect to a first radial line that extends between the axial centerline of fuel injector and the leading edge.

9. The gas turbine as in claim 8, wherein each swirler vane of the second plurality of swirler vanes includes a leading edge and a trailing edge, the trialing edge being arranged at a second swirl angle with respect to a second radial line that extends between the axial centerline of fuel injector and the leading edge, wherein the first swirl angle with respect to the first radial line and the second swirl angle with respect to the second radial line are different.

10. The gas turbine as in claim 7, wherein the fuel injector further comprises a fuel circuit defined within the outer body, wherein the fuel injection port of the swirler vane of the first plurality of swirler vanes and the fuel injection port of the swirler vane of the second plurality of swirler vanes are in fluid communication with the fuel circuit.

11. A fuel injector for a combustor, the fuel injector comprising:

an annular outer body defining an inlet, an outlet and an outer flow passage, wherein the outer flow passage tapers radially inwardly along an axial centerline of the fuel injector from the inlet to the outlet; and a radial swirler extending radially across and axially outwardly from an upstream end of the outer body, the radial swirler including a cap plate, an annular plate disposed axially between the cap plate and the upstream end of the outer body, a first plurality of swirler vanes that extends from the upstream end of the outer body to the annular plate within a first radial passage defined therebetween and a second plurality of swirler vanes that extends from the annular plate to the cap plate within a second radial passage defined therebetween;

wherein the annular plate defines an inner sleeve that defines an inner flow passage within the outer flow passage, wherein the first radial passage is in fluid communication with the outer flow passage and wherein the inner flow passage is in fluid communication with the second radial passage.

12. The fuel injector as in claim 11, wherein the inner sleeve terminates upstream from the outlet of the outer tow passage.

13. The fuel injector as in claim 11, further comprising a fuel circuit at least partially within the outer body, wherein the fuel injection port of the swirler vane of the first plurality of swirler vanes and the fuel injection port of the swirler vane of the second plurality of swirler vanes are in fluid communication with the fuel circuit.

14. The fuel injector as in claim 11, wherein each swirler vane of the first plurality of swirler vanes includes a leading edge and a trailing edge, the trialing edge being arranged at a first swirl angle with respect to a first radial line that extends between the axial centerline of fuel injector and the leading edge.

15. The fuel injector as in claim 14, wherein each swirler vane of the second plurality of swirler vanes includes a leading edge and a trailing edge, the trialing edge being arranged at a second swirl angle with respect to a second radial line that extends between the axial centerline of fuel injector and the leading edge.

16. The fuel injector as in claim 15, wherein the first swirl angle with respect to the first radial line and the second swirl angle with respect to the second radial line are different.

17. The fuel injector as in claim 15, wherein the first swirl angle is between about forty degrees to sixty degrees and the second swirl angle is between about negative forty degrees to about forty degrees.

* * * * *